United States Patent [19]

Sato

[11] 4,206,702

[45] Jun. 10, 1980

[54] CONSTANT PRESSURE PRINTING MECHANISM FOR HAND LABELER

[75] Inventor: Yo Sato, Tokyo, Japan

[73] Assignee: Kabushiki Kaisha Sato, Tokyo, Japan

[21] Appl. No.: 893,335

[22] Filed: Apr. 4, 1978

[30] Foreign Application Priority Data

Apr. 8, 1977 [JP] Japan ..... 52/039539

[51] Int. Cl.[2] ..... B41J 5/00

[52] U.S. Cl. ..... 101/291; 156/384; 101/288; 101/292; 101/316; 400/157.3; 400/166; 400/397; 400/687

[58] Field of Search ..... 101/288, 287, 291, 297, 101/292, 298, 316, 10, 20, 93.02, 93.03; 400/157.3, 166, 167, 388, 388.1, 389, 397, 424, 428, 435, 437, 440.2, 648, 652, 686, 687; 156/384; 267/158; 227/132; 74/2, 97; 173/118, 120, 139; 251/75–78, 80, 251, 262, 263

[56] References Cited

U.S. PATENT DOCUMENTS

| | | | |
|---|---|---|---|
| 1,665,467 | 4/1928 | Miller | 101/19 |
| 2,771,609 | 11/1956 | Klopstock | 227/132 |
| 4,072,105 | 2/1978 | Becker et al. | 101/316 |

*Primary Examiner*—William Pieprz

*Attorney, Agent, or Firm*—Ostrolenk, Faber, Gerb & Soffen

[57] ABSTRACT

A constant pressure printing mechanism for use with a hand labeler: an actuating lever, pivotally connected to the frame of the hand labeler, is divided into a hand lever and a printing lever, which are pivotally connected to each other; a printing head is carried by the printing lever; a shock-absorbing tensioned spring is interposed between the hand lever and the printing lever to bias them to rotate toward each other and to rotate the printing head toward the platen; a retaining lever, pivotally attached on the hand lever, is engageable with the printing platen upon descent of the printing lever; before such engagement, the retaining lever retains the hand lever on the printing lever to move together; when the printing head moves to the platen, the retaining lever is raised away from the printing lever by its engagement with the printing platen; this enables the hand lever to further pivot slightly against the biasing force of the tension spring, even when the printing head abuts against the platen, so that the shock given thereto can be absorbed to ensure printing is performed under a constant pressure.

11 Claims, 5 Drawing Figures

CONSTANT PRESSURE PRINTING MECHANISM FOR HAND LABELER

BACKGROUND OF THE INVENTION

1. Field of the Invention

The present invention relates to a label printing and applying device, principally of the portable type (which will be referred to as a "hand labeler"), and more particularly to a constant pressure printing mechanism for use in the hand labeler.

2. Description of the Prior Art

Most conventional hand labelers have an actuating lever, which is comprised of an integral hand lever and printing lever. The actuating lever is pivotally supported on a pivot pin which is positioned between the hand lever and the printing lever. A printing head is mounted to the leading end of the printing lever for being moved toward a printing platen together with the printing lever by squeezing of the hand lever.

Since the squeezing force that is applied to the hand lever of a conventional hand labeler is converted directly into printing pressure against the platen, varying squeezing forces on each imprinting are liable to produce different shadings of the imprints. If the hand lever is squeezed especially strongly and swiftly, the impact of the printing head against the platen causes the printing head to slightly bounce upon the platen which may cause double printing of the labels.

Even unclearly printed labels obtained with conventional hand labelers are considered to minimally succeed in performing their functions even if they only can be barely read out both by customers, when they purchase commodities, and by sales clerks or cashiers when they calculate the sales. In recent years, however, clerks and cashiers at check-out registers are being replaced by optical character readers which are connected with an electronic computer system. This is part of a POS (i.e., Point-of-Sale) system, in which the numerals or characters (e.g., bar codes or OCR symbols) on the labels are automatically read out, for recording and processing in the computer system, business information about each commodity, such as the stock, sales, sales analysis and profit calculation. In a POS system, the imprints on the labels must be clear at all times.

SUMMARY OF THE INVENTION

It is, therefore, an object of the present invention to provide a constant pressure printing mechanism for use in a hand labeler, or the like, which is free from the drawbacks concomitant with the conventional printing devices.

It is another object of the present invention to provide a constant pressure printing mechanism in which the printing pressure upon a label surface is kept at a constant level to accomplish clear printing of the labels at all times without any difference in shading, while reducing the impact of the printing head upon the platen to prevent double printing.

Generally explained, the invention comprises dividing an actuating lever into front and rear portions and interposing a shock-absorbing elastic member between the two lever portions.

The invention concerns a constant pressure printing mechanism for use with a hand labeler. The mechanism includes a printing platen mounted on the frame of the hand labeler. An actuating lever is also mounted on the frame of the hand labeler for pivotal movement between a released position and a squeezed position. A return spring normally biases the actuating lever toward the released position. The actuating lever is divided into an operating or hand lever and a printing lever, which are pivotally connected to each other. A printing head is carried by the printing lever. The printing head is located at an inoperative position away from the printing platen when the actuating lever is at its released position, and the printing head is located at a printing position against the printing platen when the actuating lever is being squeezed. Shock-absorbing means are interposed between the hand lever and the printing lever and they bias the two levers to pivot toward each other in a manner such that the printing lever would pivot with respect to the hand lever toward the platen. Abutments on the hand lever and the printing lever prevent such pivoting motion of the printing lever and the hand lever. Retaining means operate together with the printing platen. The retaining means cause the hand lever to move together with the printing lever when the printing head is at and starts moving away from the inoperative position. The printing lever retaining means eventually engages the platen and this moves the retaining means off the print lever. This allows pivotal movement of the hand lever relative to the printing lever, whereby the hand lever is allowed to further pivot slightly, with respect to the printing lever, against the biasing force of the shock-absorbing means, even when the printing head is at the printing position, thereby to absorb the shock given to the printing head and the platen, especially by a too rapid or strong squeeze of the hand lever.

BRIEF DESCRIPTION OF THE DRAWINGS

Other objects and advantages of the present invention will become apparent from the following description taken in conjunction with the accompanying drawings, showing a preferred embodiment of the present invention, in which.

DESCRIPTION OF THE PREFERRED EMBODIMENT

With reference to the accompanying drawings, the present invention will now be described in conjunction with the preferred embodiment thereof.

Figure 1:
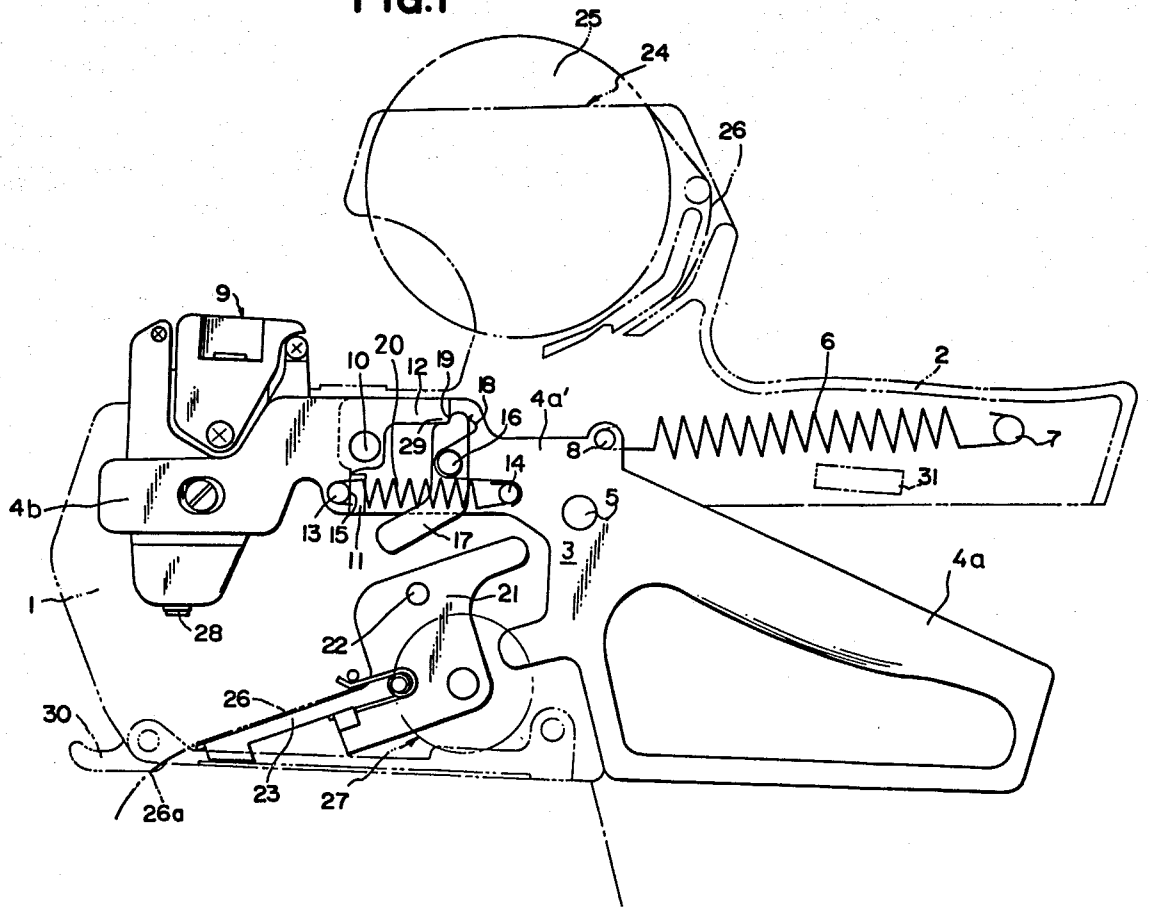
FIG. 1 is a side elevational view showing a hand labeler, which is equipped with a constant pressure printing mechanism according to the present invention, and with the side frame of the hand labeler on the viewing side being removed, for illustrative purposes.

Referring to FIG. 1, the illustrated hand labeler has two spaced apart, opposed side frames 1 that are formed at their rear portions (or right-hand portions, as viewed in the drawings) into an integral hand grip 2. The various other components of the labeler are positioned between the side frames 1.

Between the side frames 1, there is an actuating lever 3 with its middle portion pivotally connected to the frames 1 by a pivot pin 5. The actuating lever 3 is comprised of three portions. These is an operating lever, hereinafter described as a hand lever 4*a*, which is positioned at the back of the pivot pin 5. There are a pair of bifurcated extensions 4*a'* extending forward from and integral with the hand lever 4*a*. Finally, there are a pair of printing levers 4*b* pivotally connected to the forward (left hand) ends of the extensions 4*a'*.

There is a return spring 6, which is mounted under tension between a spring pin 7 on the inner wall of the grip 2 and a spring pin 8 supported on the rear ends of the extensions 4*a'* so that the actuating lever 3 will be continuously biased in the clockwise direction.

A printing head 9 is carried between the printing levers 4*b*.

Figure 4:
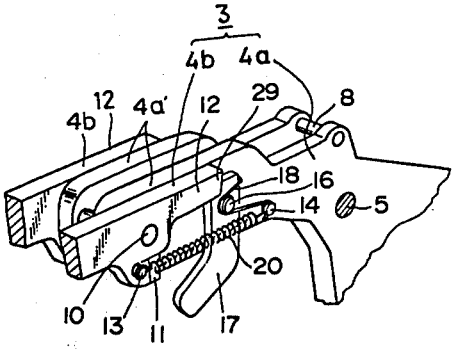
FIG. 4 is a perspective view showing the pivotal connection between a hand lever and a printing lever carrying a printing head.

FIG. 4 shows the connections between the printing levers 4*b* and the hand lever extensions 4*a'*. The levers 4*b* are pivotally connected at their rear (right hand) end portions to the outer sides of the front (left hand) end portions of the hand lever extensions 4*a'* by a pivot pin 10. The hand lever extensions 4*a'* have lower front end portions that are formed with outwardly projecting stoppers 11. The printing levers 4*b* have upper rear end portions that are formed with rearwardly projecting retainable projections 12.

A pair of shock-absorbing springs 20 are mounted under tension between pins 13 on the outer sides of the printing levers 4*b* and pins 14 on the outer sides of the hand lever extensions 4*a'*. The springs 20 normally bias the printing levers 4*b* counter-clockwise about the pivot pin 10. Since the lower rear end abutment surfaces 15 of the printing levers 4*b* abut against the stoppers 11 of the hand lever extensions 4*a'*, the printing levers 4*b* are allowed to rotate only in the clockwise, i.e., upward, direction.

Although in the foregoing description, the front half of the actuating lever 3 is divided substantially at its center into the printing levers 4*b* and the hand lever extensions 4*a'*, the invention is not restricted to such construction, in that the lever 3 can be divided at any position, such as division at the hand lever 4*a*, so long as similar results can be obtained.

Retaining means comprising a pair of stop levers 17 are pivotally connected to both outer sides of the hand lever extensions 4*a'* by the pins 16. The stop levers 17 are normally biased counterclockwise by the torsion springs 18, which are wound on the pins 16. The ends of springs 18 abut the rear surfaces of the levers 17 and the pins 14 to accomplish the above noted biasing. There are retaining recesses 19 on the upper ends of the stop levers 17. The recesses normally receive the rear corners 29 of the retainable projections 12 of the printing levers 4*b* such that the printing levers 4*b* are prohibited from clockwise rotation.

Figure 2:
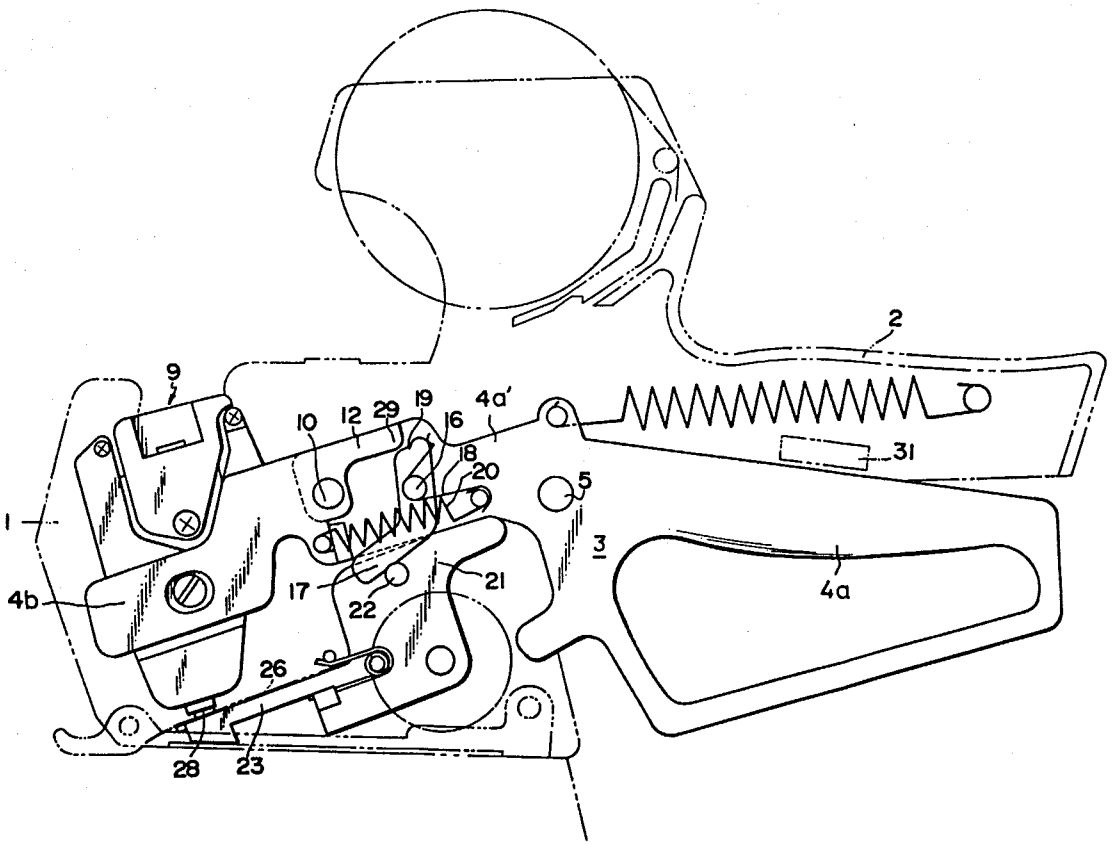
FIG. 2 is a view similar to FIG. 1 showing the hand labeler in the condition in which the hand lever has been partially squeezed.
Figure 3:
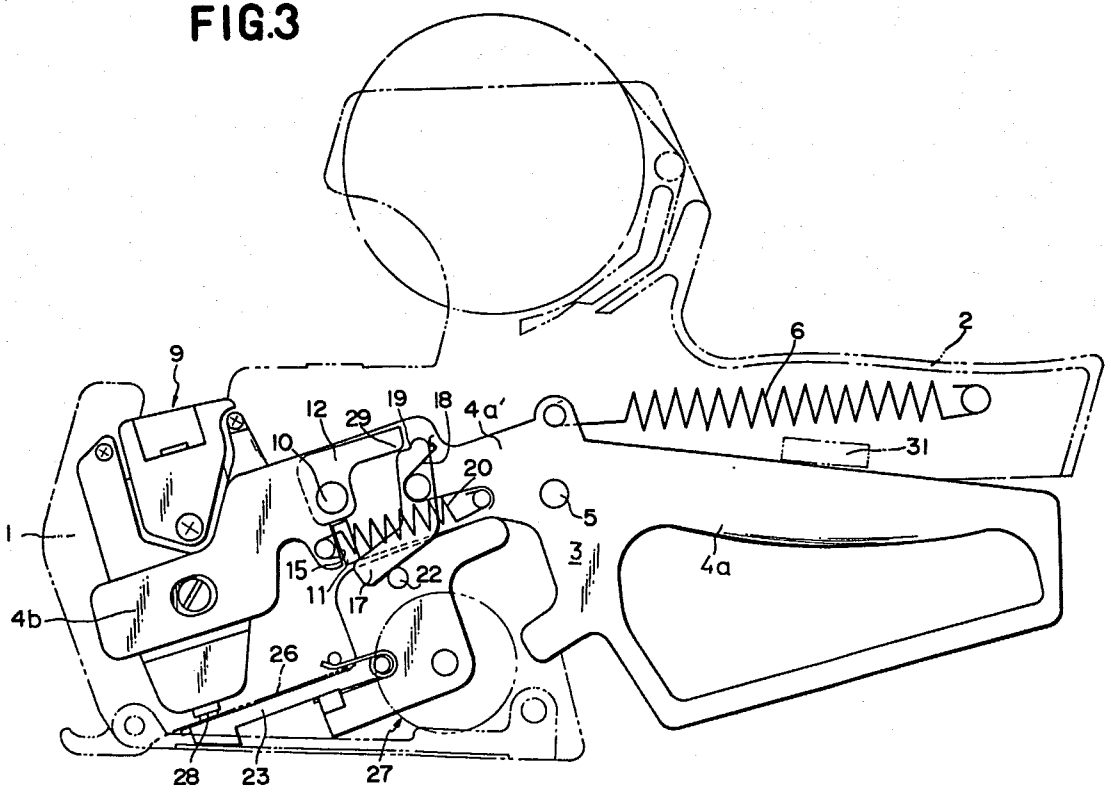
FIG. 3 is a view similar to FIGS. 1 and 2 showing the hand labeler in the condition in which the hand lever is further squeezed to its full stroke and in which the constant pressure printing mechanism has been brought into operation.

There are a pair of platen side plates 21, which are positioned below the hand lever extensions 4*a'*. A respective actuating pin 22 is secured at the outer side of each plate 21. The actuating pins 22 are so sized and positioned that the lower ends of the stop levers 17 engage the pins 22 when the hand lever extensions 4*a'* are pivoted downwardly, as seen in FIGS. 2 and 3.

There is a printing platen 23 which integrally includes the side plates 21 and a surface on which labels to be imprinted are delivered.

At the top of the frames 1, a holder 24 is placed for supporting a rolled label strip 25. A continuous label strip 26 is unrolled from roll 25 and is fed onto the printing surface of the printing platen 23 by the action of a known feed mechanism 27.

The printing head 9 is equipped with printing types 28 on its underside for being printed upon the label strip portion then overlying the platen 23. Inking roller means (not shown) roll over the printing types 28 in a manner well known in the art.

The operation of the constant pressure printing mechanism according to the present invention is now explained.

FIG. 1 shows the hand labeler in its rest condition. When the grip 2 and the hand lever 4*a* are squeezed together, the latter is pivoted upward or counterclockwise. The printing levers 4*b* connected to the extensions 4*a'* of the hand lever 4*a* are correspondingly pivoted downward or counterclockwise, which moves the printing head 9 downward. Eventually, the stop levers 17 on the hand lever abut the actuating pins 22 on the platen side plates 21 which turns the levers 17 clockwise about the pins 16. This moves the retaining recesses 19 at the upper ends of the levers 17 away from the rear corners 29 of the printing levers 4*b*.

As the hand lever 4*a* is now further squeezed, the printing head 9 is lowered, as seen in FIG. 2, until the printing types 28 engage the upper surface of the unrolled label strip 26, thus accomplishing the printing operation. Even if the hand lever 4*a* were squeezed so strongly that the types 28 of the printing head 9 might otherwise be pressed excessively hard upon the label strip 26, according to the invention, both the shock and the high pressure of the imprinting operation can be weakened. Because the front half of the actuating lever 3 is divided into the printing levers 4*b* and the hand lever extensions 4*a'*, which are pivotally connected by the pivot pin 10, as seen from FIG. 3, and because the retaining recesses 19 of the stop levers 17 are disengaged from the rear corners 29 of the printing levers 4*b*, the hand lever 4*a* and its extensions 4*a'* may therefore turn slightly counterclockwise about the pivot pin 5 against the biasing, shock absorbing action of the shock-absorbing springs 20, due to the inertia which is established when the hand lever 4*a* is squeezed. Such motion of the hand lever 4*a* stops when the hand lever 4*a* abuts a stopper 31 which is mounted in the grip 2.

Thus, even when the hand lever 4*a* is squeezed strongly, the squeezing force is not directly transmitted as printing pressure to the label surface. Instead, the force is weakened by the action of the shock-absorbing springs 20. As a result, it is possible to prevent the label surface from being imprinted with excess ink, which would make the imprint unclear, thereby ensuring clear and uniform shading of the imprint. Moreover, the shock or rebound of the printing head 9, which might otherwise occur when the hand lever 4*a* is squeezed strongly and swiftly, can also be obviated because the impact on the label caused by the printing operation is absorbed by the springs 20. This prevents double printing.

Without departing from the concept of the present invention, the tension springs 20 may be replaced by a shock-absorbing compression spring or similar elastic element which is arranged above the pivot pin 10 and between the printing levers 4*b* and the hand lever extensions 4*a'*.

When the hand lever 4*a* is released after printing a label, the actuating lever 3 is pivoted as a whole in the clockwise direction about the pivot pin 5 by the pulling action of the return spring 6 so that the printing head 9 is raised from the platen 23. Meanwhile, the stop levers 17 leave the actuating pins 22 and they are turned counterclockwise by the action of the tension spring 18 until their retaining recesses 19 are again retained by the rear corners 29 of the retainable projections 12, as seen from FIG. 1.

During the above described consecutive steps, the label strip 26 is advanced by the feed mechanism 27 so that the printed labels 26*a* may be fed beneath a label applying member 30.

The constant pressure printing mechanism according to the present invention is useful not only for hand labelers, but also for similar printing devices, such as tagging devices or desk type label printers, whether they be manually or electrically operated.

Because the actuating lever is divided into the hand lever and the printing lever, and the shock-absorbing tension spring is interposed in between, the force to squeeze the hand lever is not transmitted directly to the printing pressure. The printing pressure can be damped by the action of the tension spring, even if the hand lever is squeezed strongly. Thus, the printing can be carried out under constant and proper printing pressure so that clear imprints having uniform shading can be obtained. Moreover, the impact of imprinting can be absorbed by the tension spring so that the shock and bounce can be obviated to prevent double printing.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A constant pressure printing mechanism for use in printing labels, or the like, comprising:

an actuating lever movable between a released position and a squeezed position; said actuating lever being comprised of an operating lever and a printing lever; said operating lever being pivotally connected to said printing lever, thereby to enable said operating and printing levers to pivot with respect to one another;

a printing head carrying a printing type; said printing head being attached to said printing lever to move therewith;

a platen opposable to said printing type such that said printing type may be moved with said printing lever to imprint a label, or the like, on said platen;

said printing head being located at an inoperative position apart from said platen when said actuating lever is at the released position thereof; said printing head being located at a printing position with said types abutting a label, or the like, on said platen when said actuating lever is at the squeezed position thereof;

shock absorbing means interposed between said operating lever and said printing lever for normally biasing said operating lever and said printing lever to pivot with respect to each other and to bias said printing lever with respect to said operating lever in a direction to cause said printing type to abut said platen;

retaining means in engagement with said printing lever when said printing head is at the inoperative position thereof for blocking pivotal movement of said operating lever, with respect to said printing lever, in the direction of motion of said actuating lever to the squeezed position thereof, whereby, when said operating lever is first moved from said released position towards said squeezed position, said operating lever and printing lever move without any relative motion therebetween;

said platen being shaped for engaging said retaining means as said printing head moves toward the printing position thereof; upon engagement between said retaining means and said platen, said retaining means being moved out of engagement with said printing lever, thereby freeing said operating lever for pivoting, with respect to said printing lever, in the direction of motion of said actuating lever to the squeezed position thereof, whereby said operating lever is freed to pivot against the biasing force of said shock absorbing means, even when said printing head is at the printing position thereof.

2. The constant pressure printing mechanism of claim 1, further comprising a frame for said mechanism; said platen being supported by said frame; said actuating lever being supported by said frame for movement with respect to said frame.

3. The constant pressure printing mechanism of claim 2, wherein said actuating lever is pivotally supported by said frame for pivoting between the released and the squeezed positions thereof.

4. The constant pressure printing mechanism of any one of claims 1, 2 or 3, further comprising a return spring normally biasing said actuating lever toward the released position thereof.

5. The constant pressure printing mechanism of either of claims 1 or 3, further comprising cooperating abutting means on said printing lever and on said operating lever for normally abutting for halting pivoting, under the influence of said shock-absorbing means, of said printing lever, with respect to said operating lever, toward said platen beyond a predetermined relative pivot position between said printing lever and said operating lever.

6. The constant pressure printing mechanism of either of claims 1 or 3, wherein said shock-absorbing means comprises a tension spring between said printing lever and said operating lever and said tension spring being at that side of said pivot connection of those said levers which biases said printing lever toward said platen.

7. The constant pressure printing mechanism of either of claims 1 or 3, wherein said retaining means comprises a stop lever and stop lever biasing means for normally biasing said stop lever into a position to block pivoting of said operating lever, with respect to said printing lever, in the direction of motion of said actuating lever to the squeezed position thereof;

said platen including an actuating element positioned to be engaged by said stop lever when said printing lever passes over a preset position toward the printing position thereof;

said stop lever being so shaped and positioned and said actuating element of said platen being so placed that engagement therebetween moves said stop lever away from the position blocking the pivoting of said operating lever, with respect to said printing lever, in the direction of motion of said actuating lever to the squeezed position thereof.

8. The constant pressure printing mechanism of claim 7, wherein said stop lever is attached to and moves along with said operating lever, but is movable with respect to said operating lever under the influence of said actuating element.

9. The constant pressure printing mechanism of claim 8, wherein said stop lever is pivotally attached to said operating lever and pivots between its positions.

10. The constant pressure printing mechanism of claim 7, wherein said actuating element comprises an actuating pin on said platen and said stop lever engaging said actuating pin.

11. The constant pressure printing mechanism of claim 7, further comprising cooperating abutting means on said printing lever and on said operating lever for normally abutting for halting pivoting, under the influence of said shock-absorbing means, of said printing lever, with respect to said operating lever, toward said platen beyond a predetermined relative pivot position between said printing lever and said operating lever.

* * * * *